US007070429B2

(12) United States Patent
Kodera et al.

(10) Patent No.: US 7,070,429 B2
(45) Date of Patent: Jul. 4, 2006

(54) CARD CONNECTOR THAT CAN PREVENT BOTH LEAPING-OUT AND EJECTION FAILURE OF A CARD

(75) Inventors: Masafumi Kodera, Tokyo (JP); Joe Motojima, Tokyo (JP); Akira Natori, Tokyo (JP); Keiichiro Suzuki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/020,455

(22) Filed: Dec. 22, 2004

(65) Prior Publication Data

US 2005/0142914 A1 Jun. 30, 2005

(30) Foreign Application Priority Data

Dec. 26, 2003 (JP) ..... 2003-433079

(51) Int. Cl.
*H01R 13/62* (2006.01)

(52) U.S. Cl. ..... 439/159

(58) Field of Classification Search ..... 439/159, 439/160, 152–158

See application file for complete search history.

(56) References Cited

U.S. PATENT DOCUMENTS 6,089,891 A * 7/2000 Nishioka ..... 439/159
6,520,784 B1 * 2/2003 Ito et al. ..... 439/159
6,652,301 B1 * 11/2003 Harasawa et al. ..... 439/159
6,655,972 B1 * 12/2003 Sato ..... 439/159
6,729,892 B1 * 5/2004 Takada et al. ..... 439/159
6,776,632 B1 * 8/2004 Kikuchi et al. ..... 439/159
6,802,726 B1 * 10/2004 Chang ..... 439/159
6,817,874 B1 * 11/2004 Okabe ..... 439/157
6,843,670 B1 * 1/2005 Yamaguchi et al. ..... 439/159

FOREIGN PATENT DOCUMENTS

| | | | |
|---|---|---|---|
| JP | 5-66768 | U | 9/1993 |
| JP | 2568489 | Y2 | 1/1998 |
| JP | 11-53486 | A | 2/1999 |
| JP | 2597283 | Y2 | 4/1999 |
| JP | 3383917 | B2 | 12/2002 |

* cited by examiner

*Primary Examiner*—Gary F. Paumen
(74) *Attorney, Agent, or Firm*—Frishauf, Holtz, Goodman, Chick, P.C

(57) ABSTRACT

In a card connector for connection to a card, a housing is provided therein with a contact for contacting the card. For ejecting the card from the card connector, an ejecting mechanism includes an ejecting bar coupled to the housing and movable in directions of insertion and ejection of the card. For controlling an operation of the ejecting bar, a cam mechanism is coupled to the ejecting bar. The ejecting bare is constantly biased by an elastic member towards direction of the ejection of the card. The ejecting bar has a retaining portion for retaining the card. The ejecting bar moves along with the card with the retaining portion retaining the card when the ejecting bar is operated to eject the card from the card connector.

5 Claims, 7 Drawing Sheets

CARD CONNECTOR THAT CAN PREVENT BOTH LEAPING-OUT AND EJECTION FAILURE OF A CARD

This application claims priority to prior Japanese patent application JP 2003-433079, the disclosure of which is incorporated herein by reference.

BACKGROUND OF THE INVENTION

This invention relates to a card connector for connection to a card such as an integrated circuit card (which will often be called hereunder an IC card).

In a card connector having a so-called W-Push function that alternately repeats loading and ejection of a card every time the card is pushed, the card is forcibly ejected by a load which is obtained by pushing the card to deform a coil spring.

There is, however, a problem that the card leaps out of the connector depending on a manipulation manner.

As a countermeasure, a method is generally employed wherein a brake is provided in a card connector to exert a frictional force on a card to thereby prevent the card from leaping out of the connector.

Japanese Patent No. 3383917 (JP-B) (hereinafter referred to as Reference Document 1) describes a card connector comprising a housing and a cover covering it. At one side in the housing, the connector further comprises, as a card ejecting mechanism, an L-shaped ejecting bar and a coil spring biasing the ejecting bar toward the front end of the connector. A distal bent end portion of the L-shaped ejecting bar engages with an insertion-side end of a card so that the ejecting bar moves toward the rear end of the connector following the insertion of the card.

Every time the card is pushed for loading or ejection thereof, a heart-cam mechanism causes the ejecting bar to alternately repeat a locked state where the ejecting bar is stopped at the rear end against a biasing force of the coil spring and an unlocked state where the ejecting bar is moved forward by the biasing force of the coil spring.

The cover is provided with a plate-like brake formed by cutting. The brake has elasticity and is pushed up outward by the card upon insertion thereof so as to be in constant sliding contact with one surface of the card. When ejecting the card from the connector, the brake continues to apply a frictional force to the card while slidingly contacting the card, to thereby prevent the card from leaping out of the connector.

In the foregoing card connector, however, there may arise a problem that when the frictional force is greater than the force to eject the card achieved by the coil spring, the card is not fully ejected and stops inside the connector. In view of this, it has been difficult to increase the braking force to thereby suppress the leaping-cut of the card.

Similarly, Japanese Utility Model Registration (JP-Y) No. 2568489, Japanese Utility Model Registration (JP-Y) No. 2597283, and Japanese Utility Model Application Publication (JP-U) No. H05-66768 (hereinafter referred to as Reference Document 2, Reference Document 3, and Reference Document 4, respectively) each discloses a card connector having a brake. This card connector has a structure wherein a card is ejected via a lever by pushing a button. Specifically, a lock or brake is provided at a portion where the card is guided, and braking is achieved by sandwiching the card between the brake and a card guide. Since the braking serves as a frictional force against a force to eject the card or a force to push the button, there is possibility of occurrence of ejection failure.

On the other hand, Japanese Patent Application Publication (JP-A) No. H11-53486 (hereinafter referred to as Reference Document 5) describes a structure wherein a card is ejected by directly manipulating an eject lever. Braking is achieved by sandwiching the card between a lock or brake and a portion serving to guide the card. Since the braking serves as a frictional force against a force to eject the card or a force to manipulate the eject lever, there is possibility of occurrence of ejection failure.

SUMMARY OF THE INVENTION

It is therefore an object of this invention to provide a card connector that can prevent both leaping-out and ejection failure of a card.

Other objects of the present invention will become clear as the description proceeds.

According to an aspect of this invention, there is provided a card connector for connection to a card. The card connector comprises a contact for contacting the card, a housing provided therein with the contact, and an ejecting mechanism for ejecting the card from the card connector. The ejecting mechanism comprises an ejecting bar coupled to the housing and movable in directions of insertion and ejection of the card, a cam mechanism coupled to the ejecting bar for controlling an operation of the ejecting bar, and an elastic member constantly biasing the ejecting bar towards the direction of the ejection of the card. The ejecting bar has a retaining portion for retaining the card and. The ejecting bar moves along with the card with the retaining portion retaining the card when the ejecting bar is operated to eject the card from the card connector.

It may be arranged that the retaining portion comprises a pair of spring pieces and acts to sandwich the card between the spring contacts.

DESCRIPTION OF THE PREFERRED EMBODIMENT

In order to facilitate understanding of this invention, a conventional card connector will first be described with reference to FIGS. 1A and 1B prior to describing a preferred embodiment of this invention.

Figure 1A:
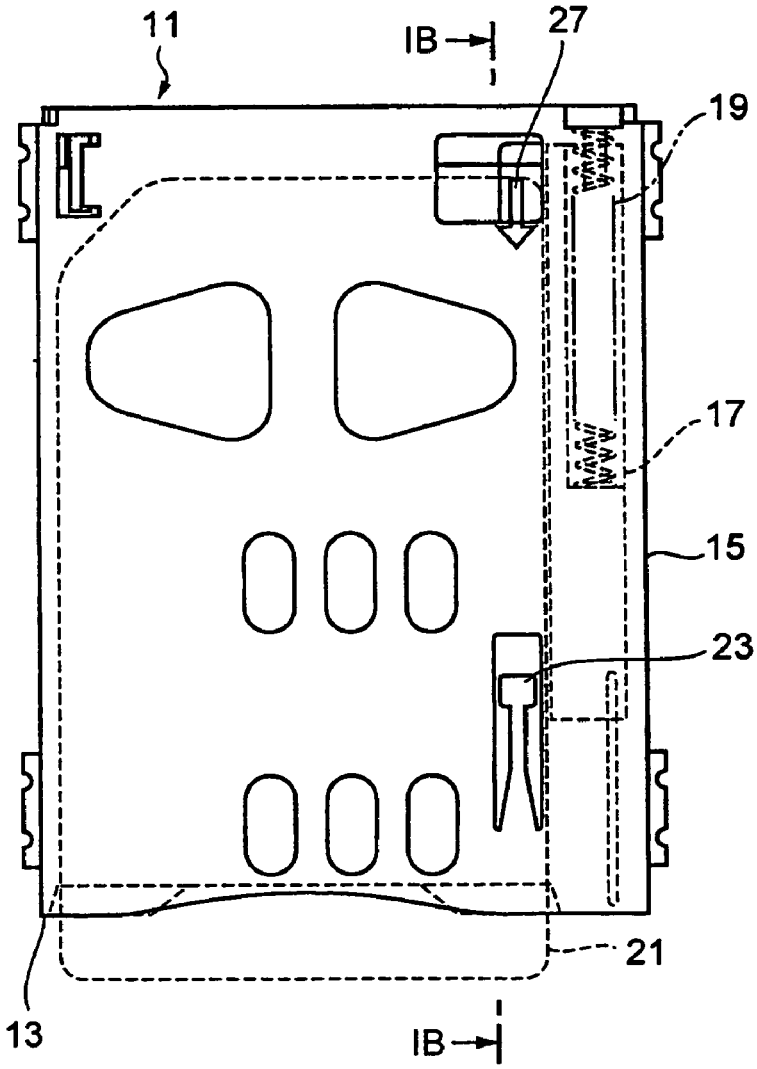
FIG. 1A PRIOR ART
FIG. 1A is a plan view showing one example of a conventional card connector.
Figure 1B:
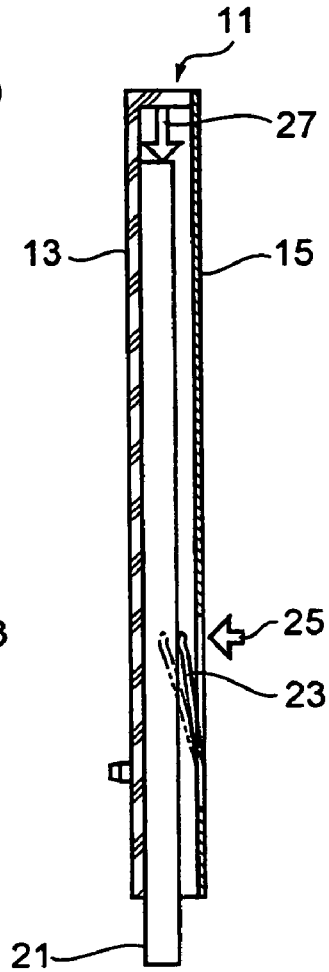
FIG. 1B PRIOR ART
FIG. 1B is a sectional view taken along line IB-IB in FIG. 1A.
Figure 2:
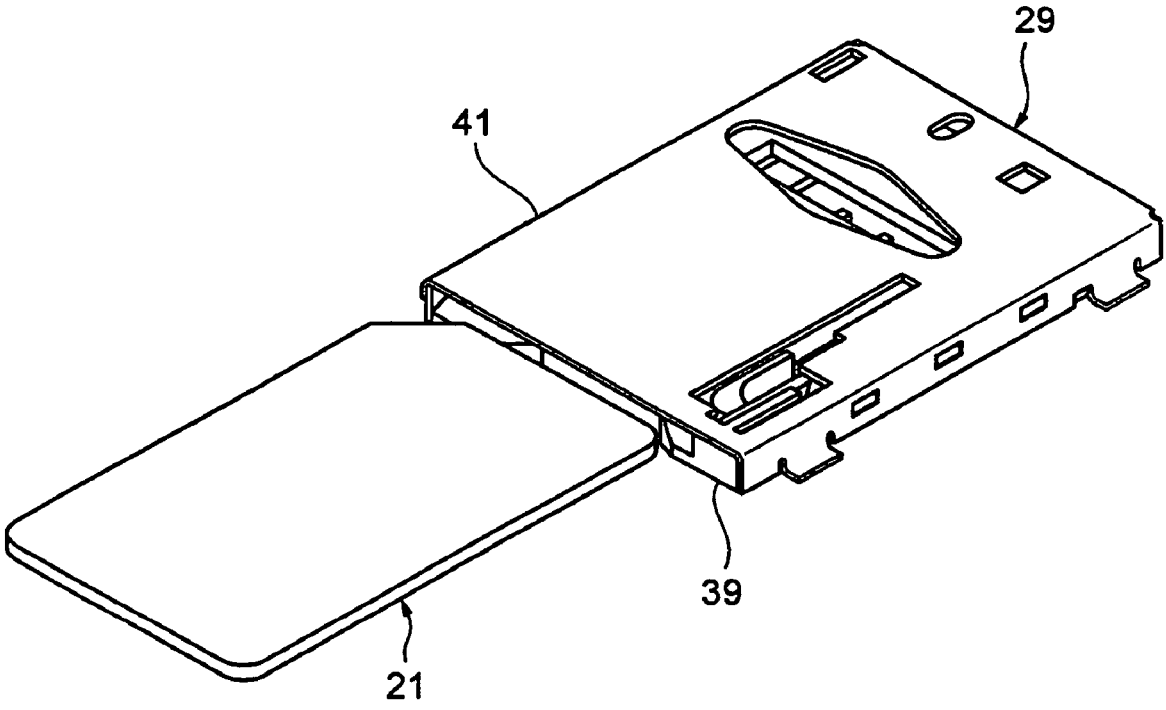
FIG. 2 is a perspective view showing an overall structure of a card connector according to a preferred embodiment of this invention.

As illustrated in FIGS. 1A and 1B, a card connector 11 according to Reference Document 1 comprises a housing 13 and a cover 15 covering it. At one side in the housing 13, an L-shaped ejecting bar 17 is provided and biased by a coil spring 19 toward the front end of the connector 11 as indicated by an arrow 27. A projecting portion of the L-shaped ejecting bar 17 is adapted to engage with an insertion-side end of a card 21 so that the ejecting bar 17 moves toward the rear end of the connector 11 following the insertion of the card 21. The cover 15 is provided with a brake 23 that Is formed by cutting so as to be inclined toward the inside of the connector 11. Every time the card 21 is pushed for loading or ejection thereof, a heart-cam mechanism (not illustrated) causes the ejecting bar 17 to alternately repeat a locked state where the ejecting bar 17 is stopped at the rear end against a biasing force of the coil spring 19 and an unlocked state where the ejecting bar 17 is moved forward by the biasing force of the coil spring 19.

The brake 23 has elasticity and is pushed up outward by the card 21 upon insertion thereof so as to be in constant sliding contact with one surface of the card 21. When ejecting the card 21 from the connector 11, the brake 23 continues to apply a frictional force to the card 21 as indicated by an arrow 25 while slidingly contacting the card 21, to thereby prevent the card 21 from leaping out of the connector 11.

In the conventional card connector 11, however, there may arise a problem that when the frictional force is greater than the force to eject the card 21 achieved by the coil spring 19, the card 21 is not fully ejected and stops inside the connector 11. In view of this, it has been difficult to increase the braking force to thereby suppress the leaping-out of the card 21.

Now, the preferred embodiment of this invention will be described with reference to FIGS. 2 to 7.

Referring to FIGS. 2 to 7, a card connector 29 according to this embodiment has the W-Push function that alternately repeats loading and ejection of a card 21 in the form of an IC card every time the card is pushed. The connector 29 comprises a housing 39 and a cover frame 41. The housing 39 has a bottom portion 31, side walls 33 and 35, and a rear wall 37 that form a rectangular box-like shape having a "]"-shape in cross section. The cover frame 41 has a "]"-shape in cross section and covers the housing 39. A box formed by the housing 39 and the cover frame 41 has a front end where an opening 43 is formed for insertion and removal of the card 21 therethrough. In the following description, the card insertion direction shall be defined as a first direction and, in this first direction, the end of the connector 29 where the opening 43 is formed shall be defined as a front end and its opposite end as a rear end. Further, the width direction of the connector 29 shall be defined as a second direction and its height direction as a third direction, wherein the first, second, and third directions are set perpendicular to each other.

Figure 3:
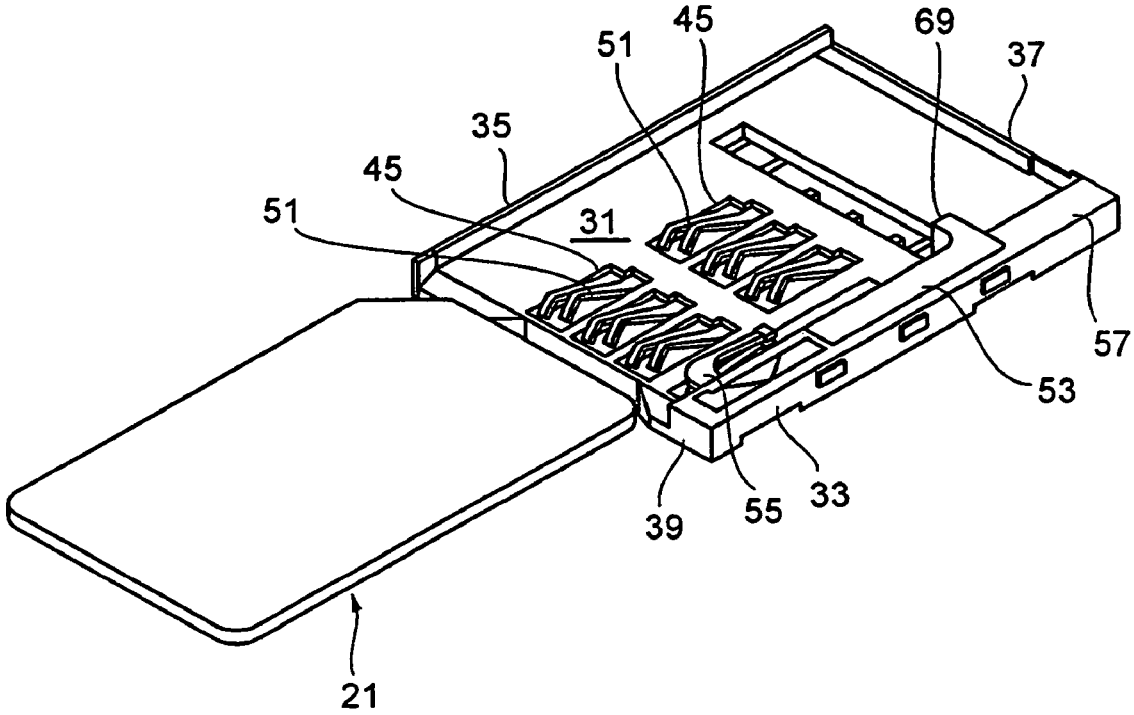
FIG. 3 is a perspective view of the card connector shown in FIG. 2 with a cover removed.

As shown in FIG. 3, the connector 29 further comprises contacts 51 for electrical connection to the card 21. The contacts 51 are provided at the bottom portion 31 of the housing 39 such that contact portions 47 thereof protrude from rectangular mounting holes 45 arrayed in two rows in the second direction. The housing 39 further serves as a guide for the card 21 and an ejecting bar 53.

Figure 4:
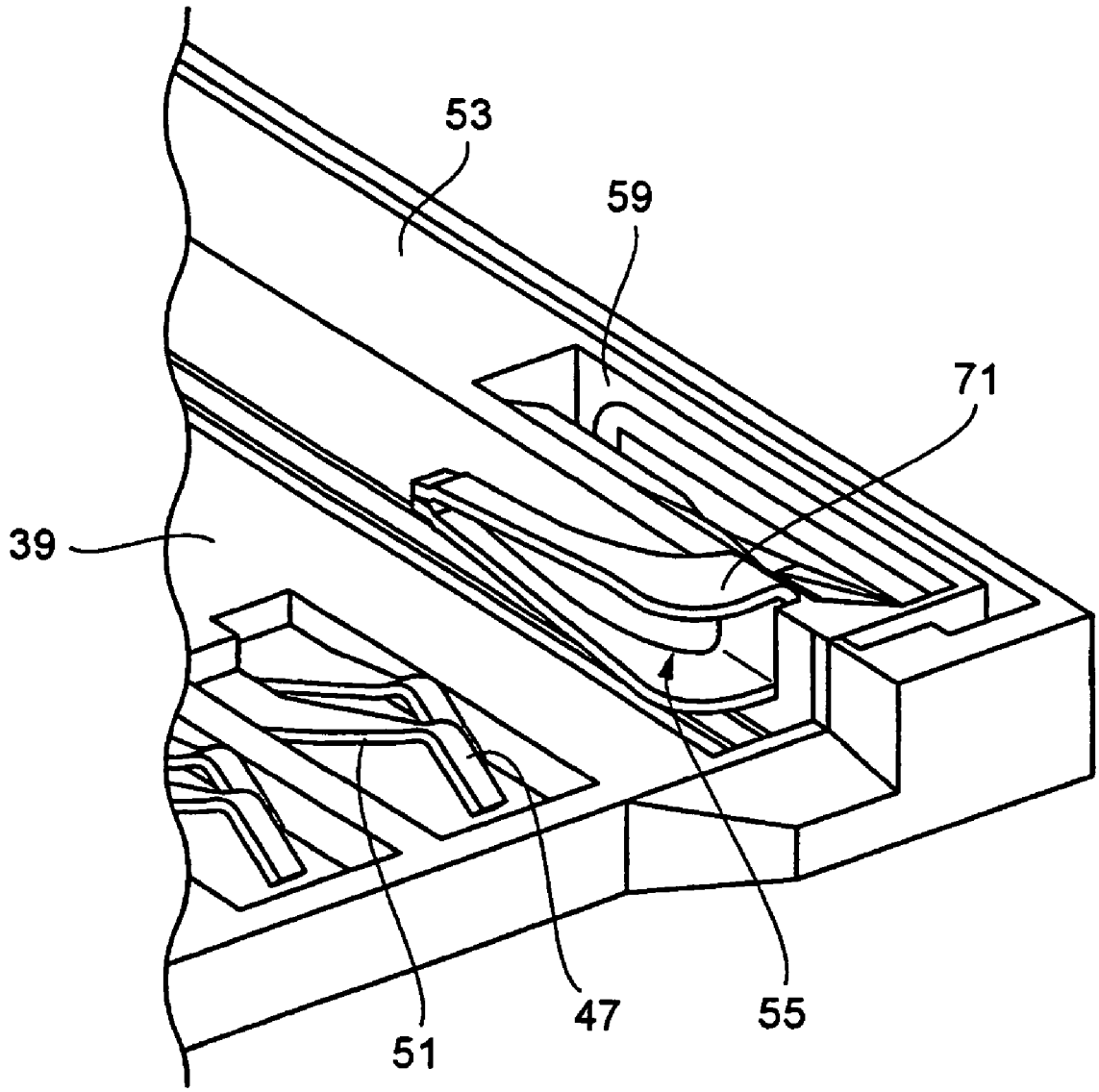
FIG. 4 is a partial perspective view showing a portion of the card connector shown in FIG. 2 in the neighborhood of a brake engaging with an ejecting bar.
Figure 5:
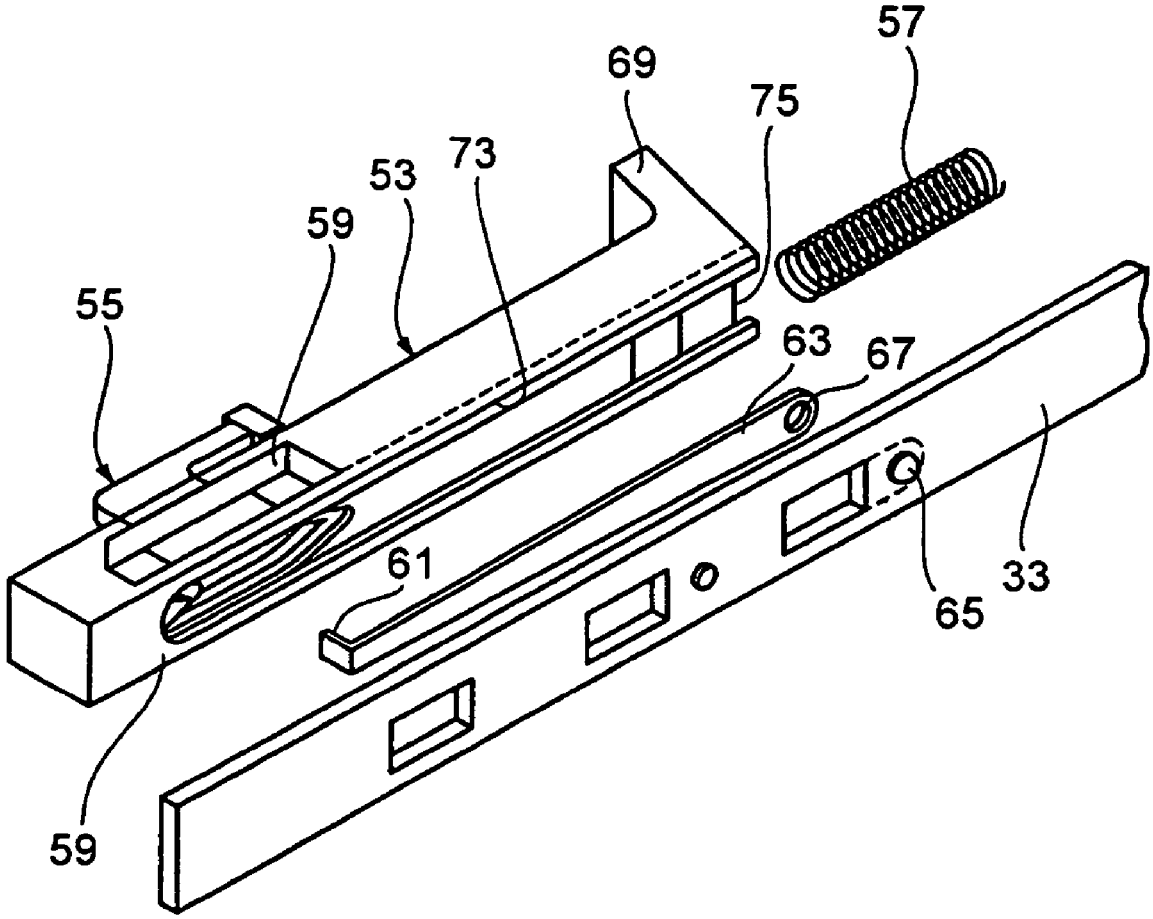
FIG. 5 is a partial exploded perspective view of a card ejecting mechanism of the card connector shown in FIG. 2.
Figure 6:
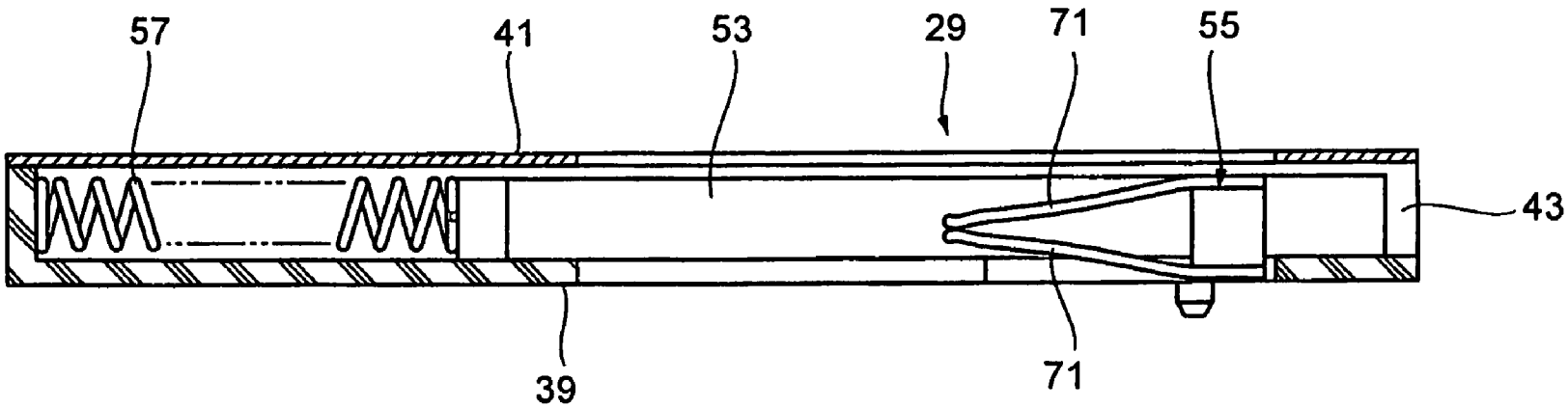
FIG. 6 is a sectional view of the card connector shown in FIG. 2 for describing operation of the brake, which shows the state before insertion of a card or after ejection of the card.

Referring also to FIGS. 4 and 5, the connector 29 further comprises, on an inner side of the side wall 33 of the housing 39, the ejecting bar 53 extending in the first direction along an inner surface of the side wall 33, a brake 55 engaging with the ejecting bar 53, and a coil spring 57 biasing the ejecting bar 53 in the first direction toward the front end from the rear end. The ejecting bar 53 is formed with a heart-cam groove 59 at a portion thereof where a base portion of the brake 55 is fixedly received. The heart-cam groove 59 constitutes part of the heart-cam mechanism. The heart-cam mechanism further comprises a cam follower 63 provided between the ejecting bar 53 and the side wall 33 of the housing 39. The cam follower 63 has an inward projecting tip end portion 61 that is inserted into the heart-cam groove 59 on the side of the ejecting bar 53. The cam follower 63 further has at its rear end a hole 67 receiving therein a pin 65 projecting into the inside of the housing 39 through the side wall 33 so that the cam follower 63 is rotatable about the pin 65. For details about the heart-cam mechanism, see paragraphs [0013], [0015], and FIG. 4 of Reference Document 1. In this embodiment, a card ejecting mechanism comprises the ejecting bar 53, the brake 55, the coil spring 57, and the heart-cam mechanism. In FIG. 5, numeral 73 denotes a lateral end of the ejecting bar 53, while numeral 75 denotes a guide groove of the ejecting bar 53.

The ejecting bar 53 is formed into an L-shape so as to have at its rear end a projection 69 that is adapted to engage with an insertion-side end of the card 21. The card 21 is ejected by a biasing force of the coil spring 57 exerted on the ejecting bar 53 that is in direct contact with the card 21.

The brake 55 comprises a pair of springs (contact pieces) 71 as a card retaining portion for sandwiching the card 21 under pressure from upper and lower sides in the figures. The brake 55 is fixed to the ejecting bar 53 and thus moves together with the ejecting bar 53 upon insertion and ejection of the card 21. This allows the card 21 to be prevented from leaping out of the connector 29 when the card 21 is ejected.

Figure 7:
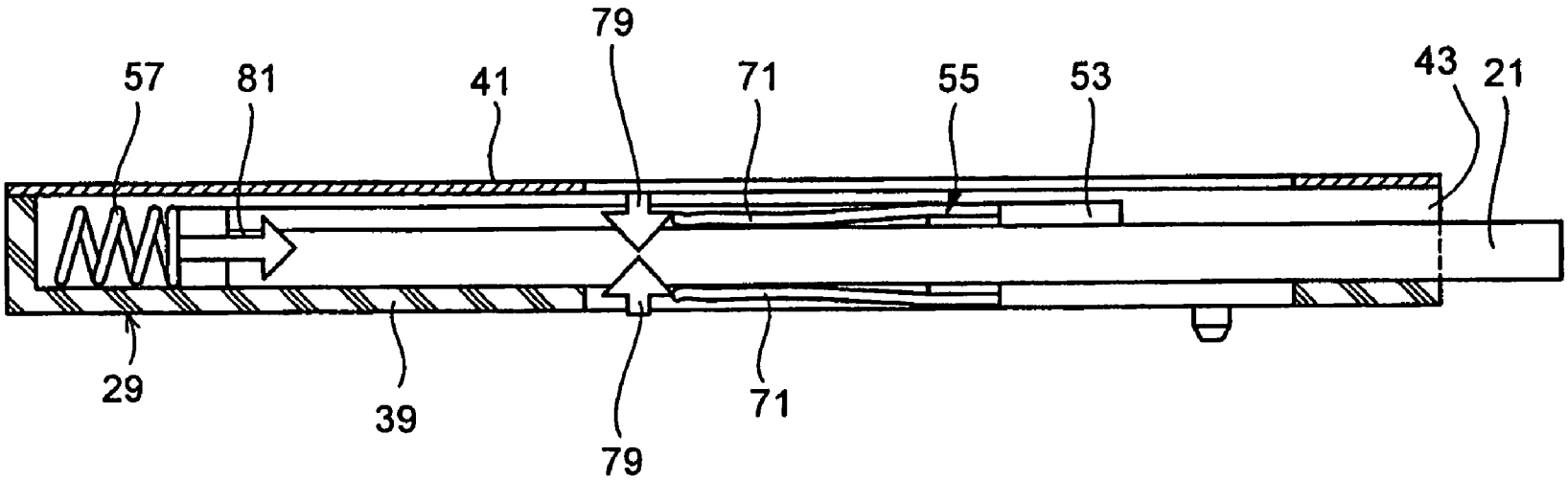
FIG. 7 is a sectional view of the card connector shown in FIG. 2 for describing operation of the brake, which shows the state where the card is loaded.

In the brake 55, although the pair of springs 71 have such elastic forces that the springs cause abrasion forces with clipping the card 21 equally from both sides, the card 21 can be clipped to be prevented from leaping out of the connector 29 when inserting or ejecting the card but can not be prevented from ejecting. When the card 21 is inserted through the opening 43 in the state of FIG. 6, the contact pieces 71, arranged in a "<"-shape, of the brake 55 are pushed open to thereby sandwich the card 21 therebetween under pressure as illustrated in FIG. 7. More specifically, as illustrated in FIG. 7, when the card 21 is inserted, the contact pieces 71 of the brake 55 sandwich the card 21 therebetween by applying the same load to the card 21 from upper and lower sides thereof as indicated by arrows 79 and move together with the ejecting bar 53 to a card loading position where the ejecting bar 53 is locked by the heart-cam mechanism so that the card 21 is loaded in the connector 29.

Then, when the card 21 is pushed in the state of FIG. 7, the ejecting bar 53 is unlocked by the heart-cam mechanism so that the ejecting bar 53 along with the card 21 is moved by the biasing force of the coil spring 57 toward the front end as indicated by an arrow 81. Because of being fixed to the ejecting bar 53, the brake 55 moves together with the ejecting bar 53 while sandwiching the card 21 under pressure even during the ejection of the card 21.

Accordingly, since the braking force of the brake 55 does not serve as a frictional force against the biasing force of the coil spring 57 to eject the card 21 via the ejecting bar 53, it is possible to increase the braking force while, at the same time, preventing occurrence of stoppage of the card 21 on the way of its ejection. Further, since the card 21 is constantly sandwiched under pressure, it is possible to prevent the leaping-out of the card 21 during the ejection. Consequently, the ejection of the card 21 can be achieved with high reliability.

As described above, in this embodiment, the card ejecting mechanism is configured to eject the card 21 by the use of the coil spring 57, which is different from the conventional mechanism of ejecting the card via the lever by pushing the button. Therefore, the ejecting bar 53 is prevented from stopping on the way of ejection of the card 21.

Further, in this embodiment, the brake 55 is fixed to the ejecting bar 53 itself serving to eject the card 21, and the card 21 is retained by the brake 55 itself. Therefore, the retaining force of the brake 55 does not function as the frictional force against the force to eject the card 21 so that it is possible to prevent occurrence of ejection failure wherein the card 21 stops on the way of its ejection.

As described above, in the prior art, the brake springs 23 are formed inside the case so that the card is often leaped out from the case or stopped on the way of ejecting the card 21. On the contrary, according to the embodiment, the brake springs 71 are formed at ejecting bar 53 so that the card 21 can not be leaped out from the case or can not be stopped on the way of ejecting the card 21.

In addition, according to this embodiment, it is possible to provide the card connector with high reliance that can prevent both the leaping-out and the ejection failure of the card 21.

In this embodiment, the description has been given about the example wherein the card is the IC card, but it is readily understood that this invention is applicable to so-called electronic cards incorporating electronic circuit elements, not limited to the IC card.

As described above, the card connector according to this invention has high reliability and is applicable to card slots of personal computers, and card connectors of portable mobile terminals, various digital devices, and various electrical and electronic devices.

While this invention has thus far been described in connection with the preferred embodiment thereof, it will be readily possible for those skilled in the art to put this invention into practice in various other manners without departing from the scope set forth in the appended claims.

What is claimed is:

1. A card connector for connection to a card, comprising:

a contact for contacting the card;

a housing in which said contact is provided; and an ejecting mechanism for ejecting the card from said card connector, said ejecting mechanism comprising:

an ejecting bar coupled to said housing and movable in directions of insertion and ejection of the card;

a cam mechanism coupled to said ejecting bar for controlling an operation of said ejecting bar; and an elastic member constantly biasing said ejecting bar towards the direction of ejection of the card;

wherein said ejecting bar comprises a retaining portion for retaining the card, and said ejecting bar moves along with the card with said retaining portion retaining the card when said ejecting bar is operated to eject the card from said card connectors; and wherein the retaining portion comprises a pair of spring pieces and sandwiches the card between the spring pieces.

2. The card connector according to claim 1, wherein said contact is disposed so as to face one surface of the card that is inserted in said card connector.

3. The card connector according to claim 1, wherein said cam mechanism comprises:

a heart-cam groove formed on said ejecting bar; and a cam follower having a first end inserted into said heart-cam groove and a second end which is opposite to said first end and is rotatably attached to an inner wall of said housing.

4. The card connector according to claim 1, wherein said card connector has one surface that is mounted on a board so as to face a surface of said board.

5. The card connector according to claim 1, wherein the card comprises an IC card.

* * * * *